US008490859B1

(12) United States Patent
Master et al.

(10) Patent No.: US 8,490,859 B1
(45) Date of Patent: Jul. 23, 2013

(54) ROTATING MAILBOX DEVICE

(76) Inventors: Brett A. Master, Fountain, FL (US); Donald A. Bland, Laurel Hill, FL (US); Theresa K. Master, Fountain, FL (US)

( * ) Notice: Subject to any disclaimer, the term of this patent is extended or adjusted under 35 U.S.C. 154(b) by 0 days.

(21) Appl. No.: 13/556,417

(22) Filed: Jul. 24, 2012

(51) Int. Cl.
*A47G 29/12* (2006.01)

(52) U.S. Cl.
USPC ..... 232/39; 232/17; 232/34; 232/38; 40/566; 248/131; 248/415; 248/418

(58) Field of Classification Search
USPC ..... 232/34, 17, 45, 39, 38; 40/566, 606.06; 248/131, 145, 415, 417, 418, 349.1, 125.7; 362/154
See application file for complete search history.

(56) References Cited

U.S. PATENT DOCUMENTS 5,400,958 A * 3/1995 Walker ..... 232/39
5,458,286 A * 10/1995 Paschal ..... 232/39
5,460,325 A * 10/1995 Surman ..... 232/17
5,622,343 A * 4/1997 Morton ..... 248/131
5,779,202 A 7/1998 Black et al.
6,164,527 A 12/2000 Garey
6,299,325 B1 10/2001 Cathel
6,708,876 B1 * 3/2004 Shirah ..... 232/38
6,719,193 B2 * 4/2004 Katulka ..... 232/38
6,964,366 B2 * 11/2005 Peng et al. ..... 232/38
7,249,704 B1 7/2007 Smith et al.
7,578,085 B1 * 8/2009 Chao et al. ..... 40/564

* cited by examiner

*Primary Examiner* — William L. Miller

(57) ABSTRACT

The rotating mailbox device is provided in varying degrees of complexity, with each embodiment thereof focused on as basic a design as is possible while still retaining the important features of the device. Even the most basic design provides illuminated address, illumination strips within the mailbox assembly, and exterior indicators for indicating mail received via sensing of door opening. Of importance is that the basic design of the device dictates that the dished tray is rotateably affixed directly atop the post and may also be affixed off-center regarding the tray. The direct post-to-tray attachment negates the need for further attachment devices such as horizontal arms, for example. Lateral attachment of the mailbox assembly to the platform elevated section provides for easiest disassembly of part of the device and also for the elevated section to be a floor for the mailbox assembly.

11 Claims, 7 Drawing Sheets

ROTATING MAILBOX DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

It is common knowledge that a mailbox facing a given direction is not always convenient for both mail delivery person and box user. This can be especially true in inclement weather, wherein a user may be required to exit a given vehicle in order to access mail. Yet, mailboxes must be turned to accommodate a delivery person, so a stationary mailbox remains ineffectual at times. The present device provides a unique solution to this problem and to others.

FIELD OF THE INVENTION

The rotating mailbox device relates to mailboxes and more especially a mailbox that selectively rotates for the convenience of a postman and a user.

SUMMARY OF THE INVENTION

The general purpose of the rotating mailbox device, described subsequently in greater detail, is to provide a rotating mailbox device which has many novel features that result in an improved rotating mailbox device which is not anticipated, rendered obvious, suggested, or even implied by prior art, either alone or in combination thereof.

To attain this, the rotating mailbox device is provided in varying degrees of complexity, with each embodiment thereof focused on as basic a design as is possible while still retaining the important features of the device. Even the most basic design may provide illuminated address, illumination strips within the mailbox assembly, and exterior indicators for indicating mail received via sensing of door opening. Of importance is that the basic design of the device dictates that the dished tray is rotateably affixed directly atop the post and may also be affixed off-center regarding the tray. The direct post-to-tray attachment negates the need for further attachment devices such as horizontal arms, for example.

Lateral attachment of the mailbox assembly to the platform elevated section provides for easiest disassembly of part of the device and also for the elevated section to be a floor for the mailbox assembly.

Thus has been broadly outlined the more important features of the improved rotating mailbox device so that the detailed description thereof that follows may be better understood and in order that the present contribution to the art may be better appreciated.

An object of the rotating mailbox device is to provide convenience for both a postman and a user.

Another object of the rotating mailbox device is to rotate to accommodate both a postman and a user by selectively rotating to face each.

A further object of the rotating mailbox device is to rotate automatically.

An added object of the rotating mailbox device is to rotate mechanically.

And, an object of the rotating mailbox device is to protect both user and postman from inclement weather exposure.

Another object of the rotating mailbox device is to provide various lighting features within and without the mailbox assembly for user convenience.

These together with additional objects, features and advantages of the improved rotating mailbox device will be readily apparent to those of ordinary skill in the art upon reading the following detailed description of presently preferred, but nonetheless illustrative, embodiments of the improved rotating mailbox device when taken in conjunction with the accompanying drawings.

DETAILED DESCRIPTION OF THE DRAWINGS

With reference now to the drawings, and in particular FIGS. 1 through 7 thereof, the principles and concepts of the rotating mailbox device generally designated by the reference number 10 will be described.

Figure 7:
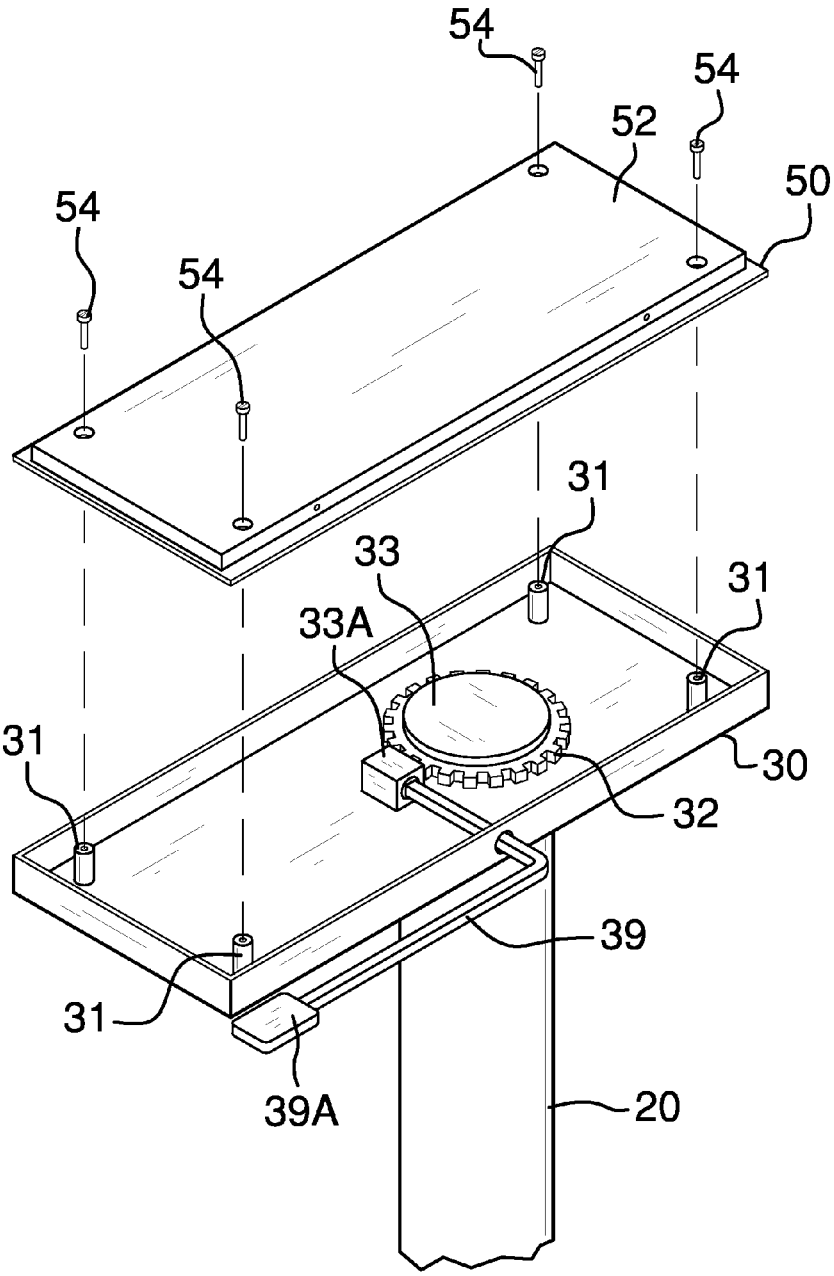
FIG. 7 is a perspective exploded view of the post, dished tray, and platform.

Referring to FIG. 7, the device 10 partially comprises a cylindrical post 20. A dished tray 30 is affixed rotateably and directly atop the post 20. A plurality of pedestals 31 is extended upwardly from within the dished tray 30. A pivot gear 32 is affixed within the dished tray 30, directly above the post 20. A limit disk 33 is affixed atop the pivot gear 32. A position lock 33A is affixed within the dished tray 30. The position lock 33A is in communication with the pivot gear 32.

Figure 6:
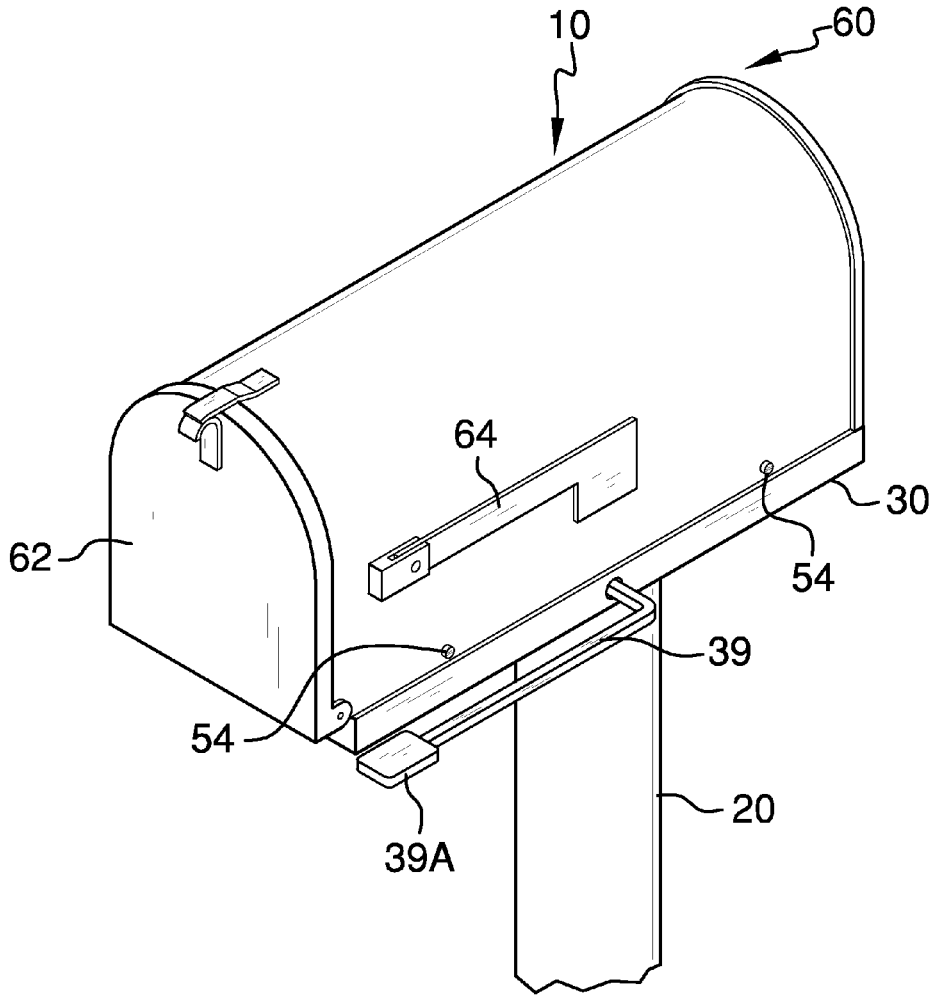
FIG. 6 is a perspective view having a manually operated rotating mailbox.

Referring to FIG. 6 and continuing to refer to FIG. 7, a right angled position lever 39 is extended outwardly from the position lock 33A.

Figure 4:
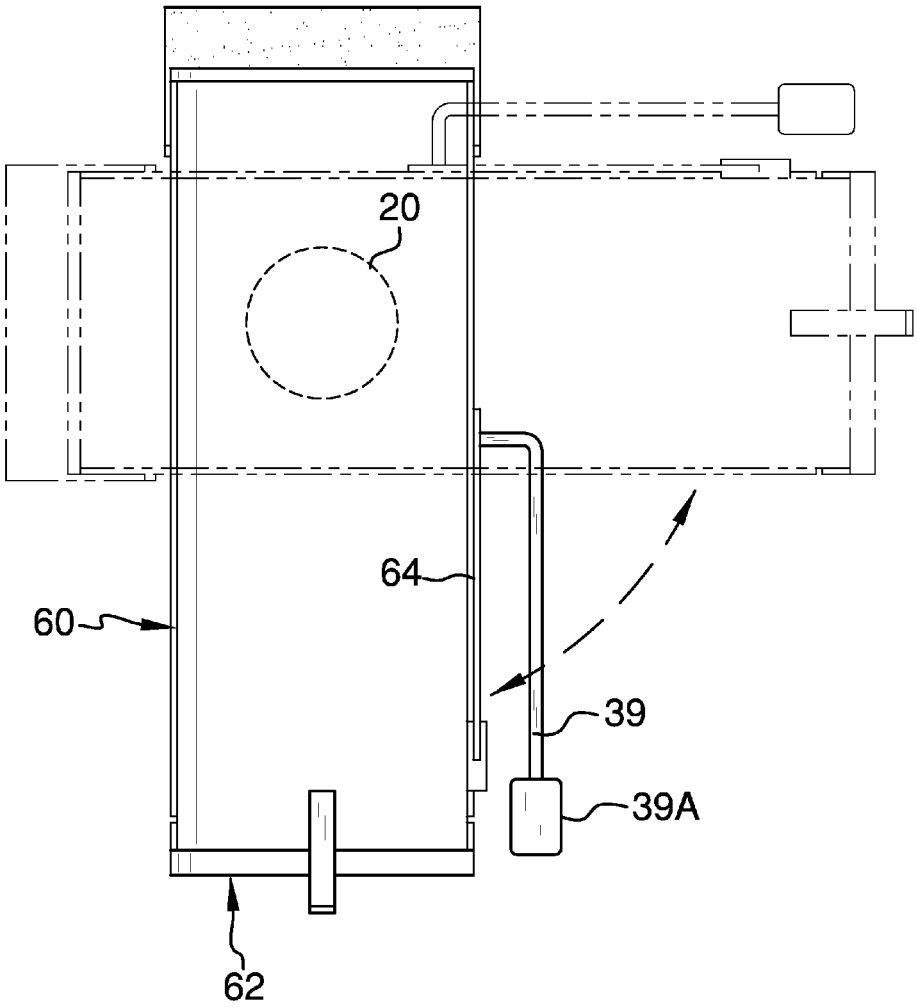
FIG. 4 is a top plan view.

Referring to FIG. 4, the right angled position lever 39 is terminated outside of the dished tray 30. A push pad 39A is disposed distally on the right angled position lever 39. The right angled position lever 39 is configured to rotate the dished tray 30 from a first position to a second position of about 90 degrees rotation from the first position, or at an any position between the first position and the second position.

Referring again to FIG. 7, a platform 50 is removably disposed within the dished tray 30 and atop the pedestals 31 via fasteners 54. An elevated section 52 is extended upwardly from the platform 50.

Referring again to FIG. 6, a mailbox assembly 60 is removably affixed atop the elevated section 52 via horizontally disposed fasteners 54. The mailbox assembly 60 comprises a door 62 disposed at a one end. A flag 64 is pivotally disposed on the mailbox assembly 60.

Figure 1:
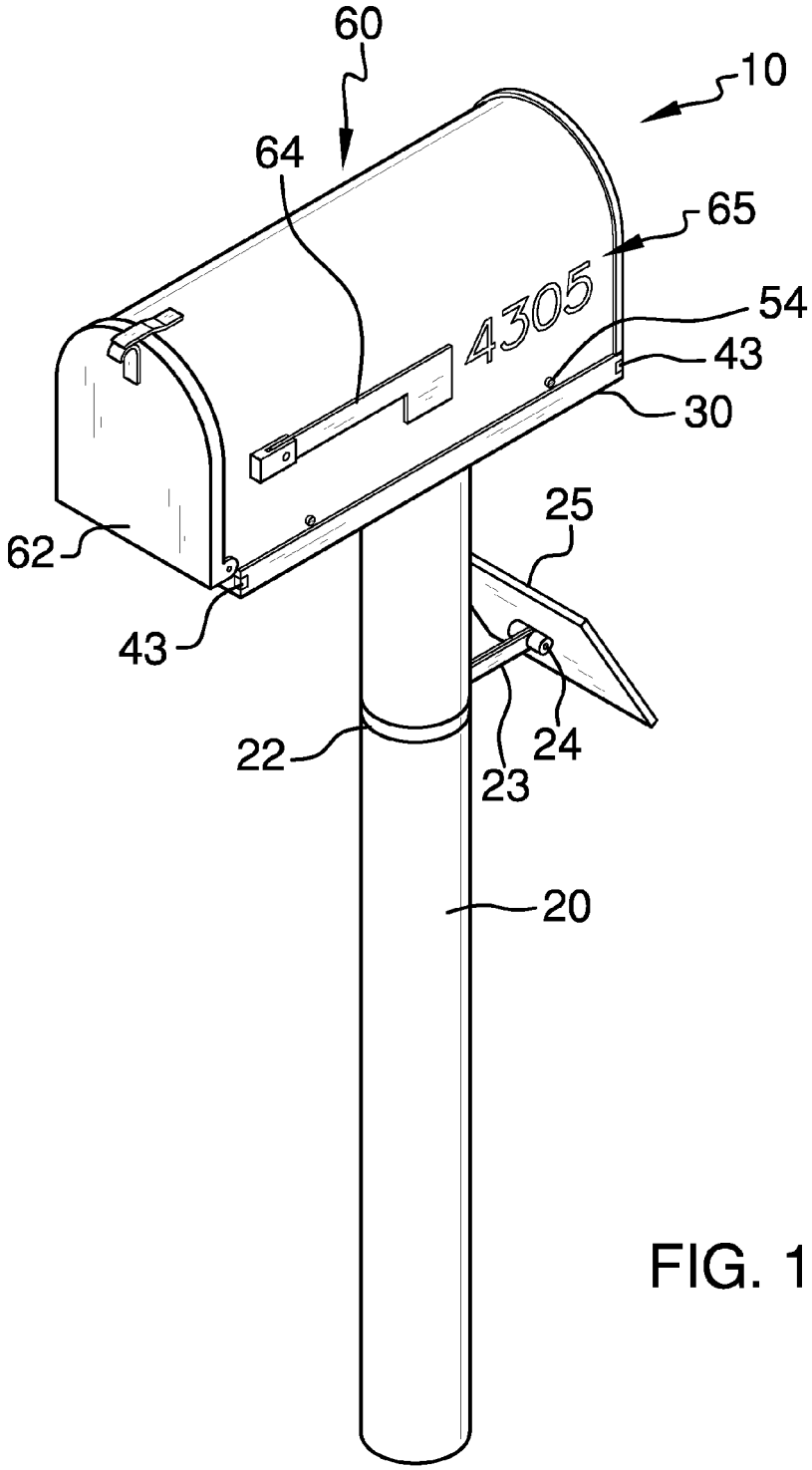
FIG. 1 is a perspective view.

Referring to FIG. 1, the device 10 comprises a more complex embodiment.

Referring to FIG. 1 and FIG. 6, the device 10 may comprise and share any number of optional features, in either embodiment, that are explained herein.

Figure 2:
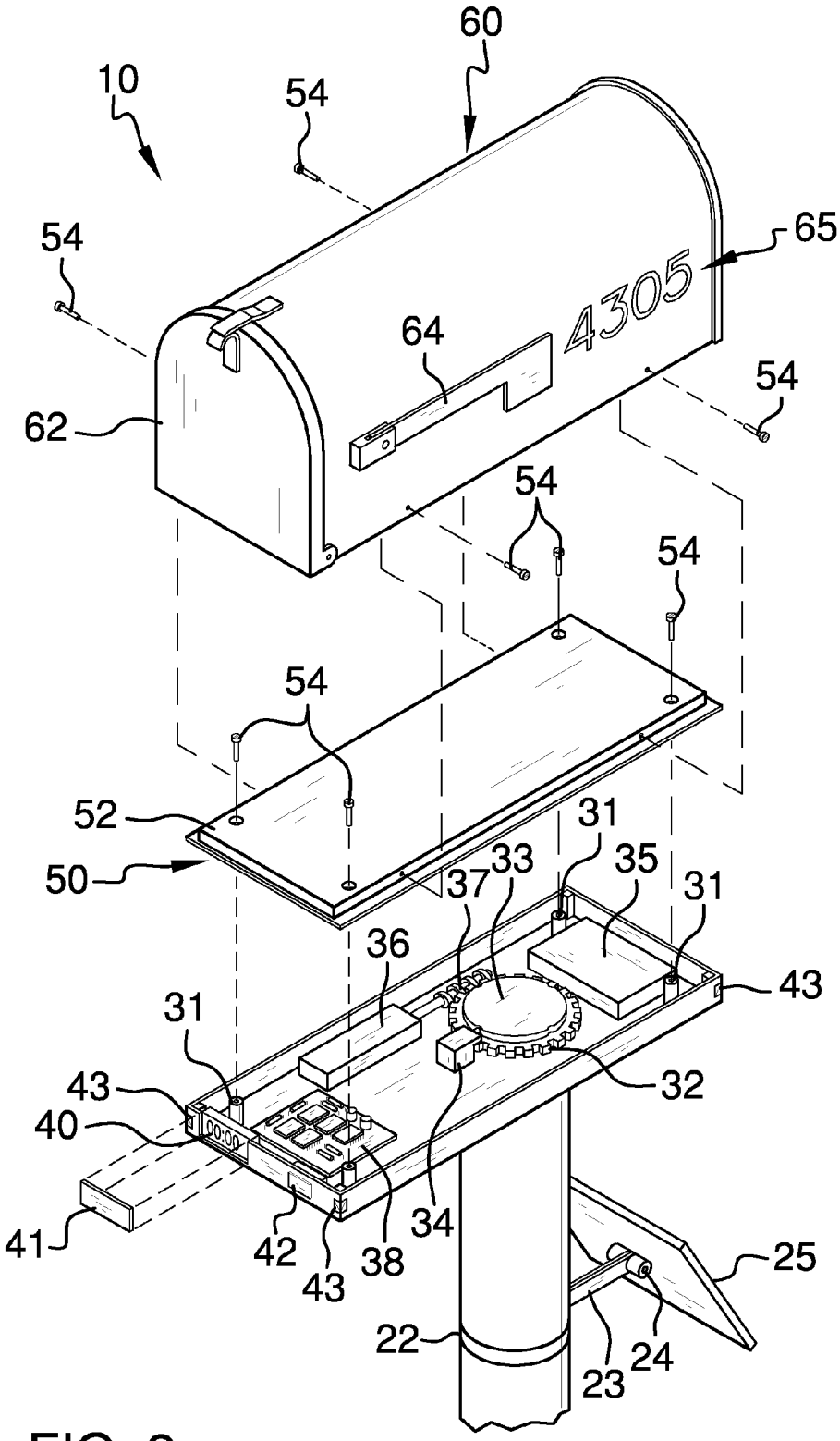
FIG. 2 is an exploded perspective view.

Referring to FIG. 2, the position lock 33A along with the right angled position lever 39 illustrated in FIG. 7 are negated. The device 10 shares with the embodiment of FIG. 7 the cylindrical post 20.

Figure 5:
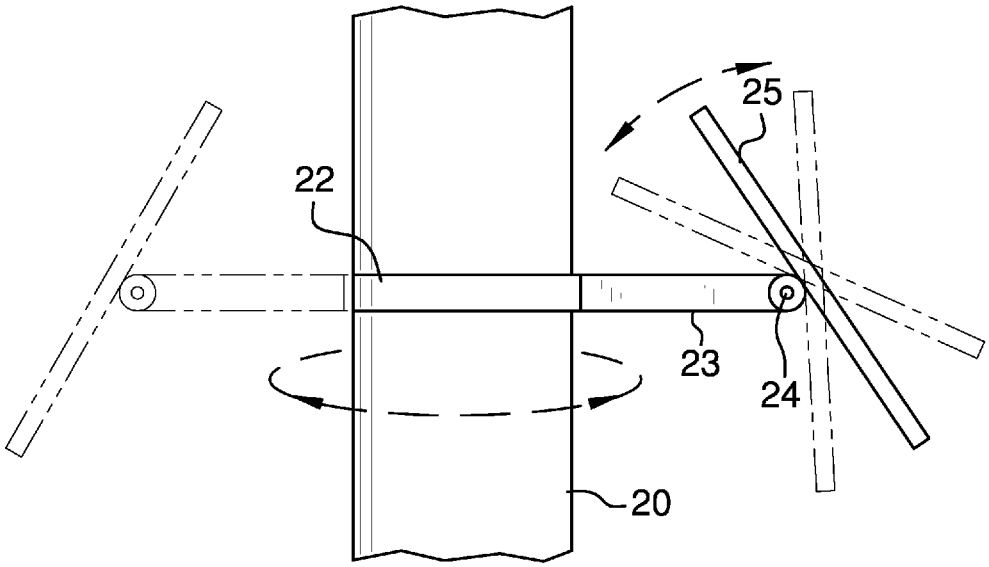
FIG. 5 is lateral elevation view of the post with rotateably fastened collar with arm, hingedly fastened solar panel.

Referring to FIG. 5, a rotatable collar 22 is disposed as chosen along the post 20. An arm 23 is extended laterally from the rotatable collar 22. A solar panel 25 is affixed to the arm 23 via a hinge 24. The hinge 24 is configured to provide upward and downward movement of the solar panel 25.

Referring to FIG. 2, the dished tray 30 is affixed rotateably atop the post 20. A battery pack 35 is disposed within the dished tray 30. The battery pack 35 is in communication with the solar panel 25 for recharging of the battery pack 35. The plurality of pedestals 31 is extended upwardly from within the dished tray 30. The pivot gear 32 is affixed within the dished tray 30, directly above the post 20. The limit disk 33 is affixed atop the pivot gear 32. A limit switch 34 is disposed within the dished tray 30, adjacent to the pivot gear 32. The limit switch 34 is in communication with the limit disk 33. A drive motor 36 is disposed within the dished tray 30. A worm gear 37 is extended from the drive motor 36. The worm gear 37 is in communication with the pivot gear 32. A clock with menu and display 40 is disposed within the dished tray 30. A removable cover 41 is disposed exteriorly on the clock with menu and display 40. A reset button 42 is exposed exteriorly on the dished tray 30. A processor 38 is disposed within the dished tray 30. The processor 38 is in communication with the battery pack 35, the limit switch 34, and the reset button 42. The clock with menu and display 40, the processor 38, reset button 42, and limit switch 34 are configured to rotate the dished tray 30 from a first position to a second position of about 90 degrees rotation from the first position, or at an any position between the first position and the second position.

Continuing to refer to FIG. 2, the platform 50 is removably disposed atop and within the dished tray 30 and atop the pedestals 31 via fasteners 54. The elevated section 52 is extended upwardly from the platform 50. The mailbox assembly 60 is removably affixed atop the elevated section 52 via horizontally disposed fasteners 54. The mailbox assembly 60 comprises the door 62 disposed at one end and the flag 64 pivotally disposed on the mailbox assembly 60.

Figure 3:
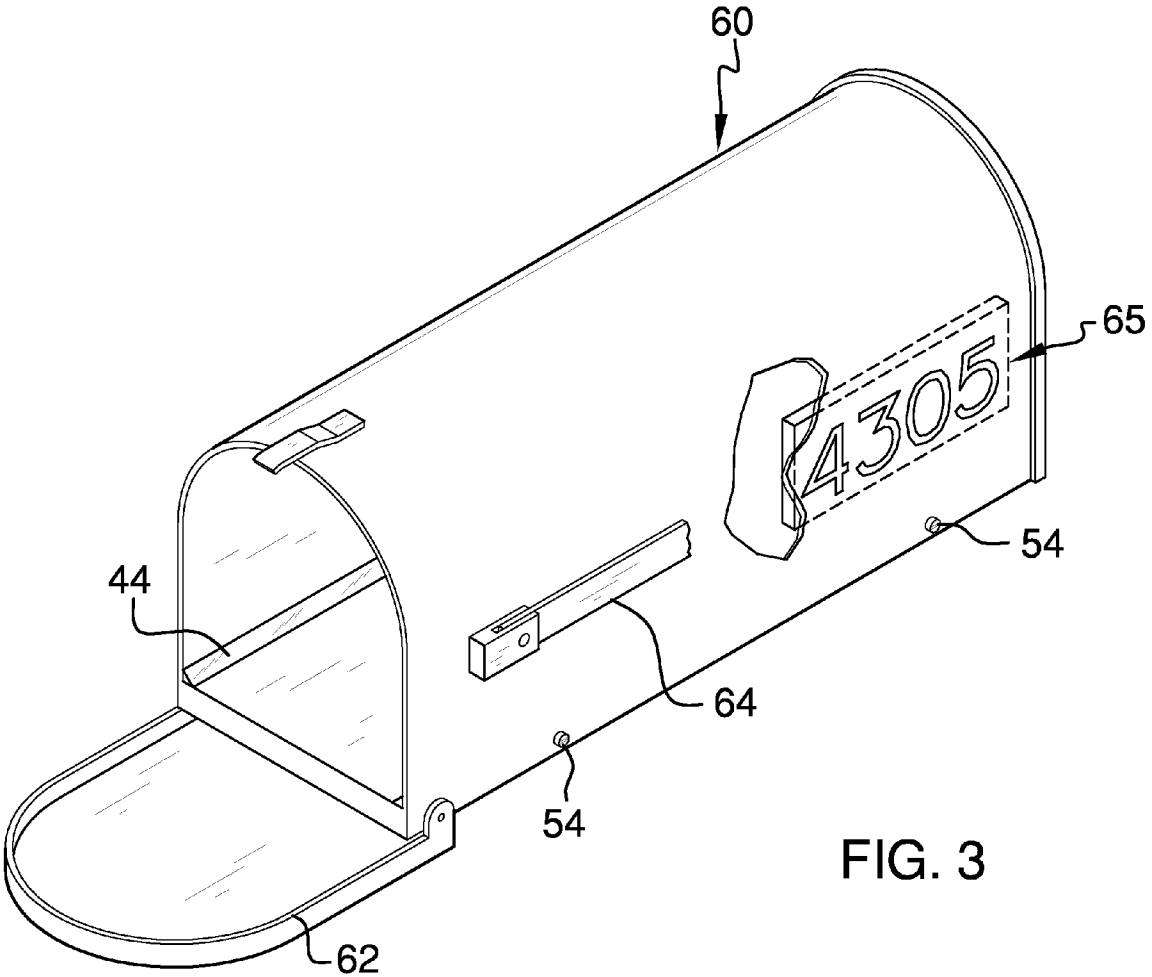
FIG. 3 perspective view of the open door mailbox assembly.

Referring to FIG. 3, the device 10 further comprises an at least one illumination strip 44 disposed longitudinally within the mailbox assembly 60. Another illumination strip 44 may be disposed within an opposite side of the mailbox assembly 60. Each illumination strip 44 is in communication with the battery pack 35 and the processor 38.

Referring again to FIG. 3, the device 10 further comprises an illuminated address 65 disposed within the mailbox assembly 60 and visible exteriorly on the mailbox assembly 60. The illuminated address 65 is in communication with the processor 38.

Referring to FIGS. 1 and 2, the dished tray further comprises a plurality of indicators 43 disposed within and exteriorly visible from the dished tray 30. The indicators 43 are in communication with the processor 38 whereby the indicators 43 are alight when the mailbox assembly 60 door 62 has been opened since the reset button 42 was pressed.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the rotating mailbox device may be used.

What is claimed is:

1. A rotating mailbox device comprising, in combination:
a cylindrical post;
a dished tray affixed rotateably and directly atop the post;
a plurality of pedestals extended upwardly from within the dished tray;
a pivot gear affixed within the dished tray, directly above the post;
a limit disk affixed atop the pivot gear;
a position lock affixed within the dished tray, the position lock in communication with the pivot gear;
a right angled position lever extended outwardly from the position lock, the right angled position lever terminated outside of the dished tray;
a push pad disposed distally on the right angled position lever, the right angled position lever configured to rotate the dished tray from a first position to a second position within a range of about 90 degrees rotation from the first position;
a platform removably disposed within the dished tray and atop the pedestals via fasteners;
an elevated section extended upwardly from the platform;
a mailbox assembly removably affixed atop the elevated section via horizontally disposed fasteners, the mailbox assembly comprising:
a door disposed at a-one end;
a flag pivotally disposed on the mailbox assembly.

2. A rotating mailbox device comprising, in combination:
a cylindrical post;
a rotatable collar disposed along the post;
an arm extended laterally from the rotatable collar;
a solar panel affixed to the arm via a hinge, the hinge configured to provide upward and downward movement of the solar panel;
a dished tray affixed rotateably atop the post;
a battery pack disposed within the dished tray, the battery pack in communication with the solar panel;
a plurality of pedestals extended upwardly from within the dished tray;
a pivot gear affixed within the dished tray, directly above the post;
a limit disk affixed atop the pivot gear;
a position lock affixed within the dished tray, the position lock in communication with the pivot gear;
a right angled position lever extended outwardly from the position lock, the right angled position lever terminated outside of the dished tray;
a push pad disposed distally on the right angled position lever, the right angled position lever configured to rotate the dished tray from a first position to a second position within a range of about 90 degrees rotation from the first position;
a platform removably disposed within the dished tray and atop the pedestals via fasteners;
an elevated section extended upwardly from the platform;
a mailbox assembly removably affixed atop the elevated section via horizontally disposed fasteners, the mailbox assembly comprising:
a door disposed at a-one end;
a flag pivotally disposed on the mailbox assembly;

an illuminated address disposed within the mailbox assembly and visible exteriorly on the mailbox assembly, the illuminated address in communication with the battery pack.

3. The device according to claim 2 further comprising an at least one illumination strip disposed longitudinally within the mailbox assembly, the illumination strip in communication with the battery pack.

4. The device according to claim 2 further comprising an at least one illumination strip disposed longitudinally within the mailbox assembly, each illumination strip in communication with the battery pack and the processor.

5. The device according to claim 4 further comprising an illuminated address disposed within the mailbox assembly and visible exteriorly on the mailbox assembly, the illuminated address in communication with the processor.

6. The device according to claim 5 further comprising a plurality of indicators disposed within and exteriorly visible from the dished tray, the indicators in communication with the processor.

7. The device according to claim 4 further comprising a plurality of indicators disposed within and exteriorly visible from the dished tray, the indicators in communication with the processor.

8. A rotating mailbox device comprising, in combination:

a cylindrical post;

a rotatable collar disposed along the post;

an arm extended laterally from the rotatable collar;

a solar panel affixed to the arm via a hinge, the hinge configured to provide upward and downward movement of the solar panel;

a dished tray affixed rotateably atop the post;

a battery pack disposed within the dished tray, the battery pack in communication with the solar panel;

a plurality of pedestals extended upwardly from within the dished tray;

a pivot gear affixed within the dished tray, directly above the post;

a limit disk affixed atop the pivot gear;

a limit switch disposed within the dished tray, adjacent to the pivot gear, the limit switch in communication with the limit disk;

a drive motor disposed within the dished tray;

a worm gear extended from the drive motor, the worm gear in communication with the pivot gear;

a clock with menu and display disposed within the dished tray;

a removable cover disposed exteriorly on the clock with menu and display;

a reset button exposed exteriorly on the dished tray;

a processor disposed within the tray, the processor in communication with the battery pack, the limit switch, the reset button, and the clock with menu and display;

the processor, reset button, and limit switch configured to rotate the dished tray from a first position to a second position within a range of about 90 degrees rotation from the first position;

a platform removably disposed within the dished tray and atop the pedestals via fasteners;

an elevated section extended upwardly from the platform;

a mailbox assembly removably affixed atop the elevated section via horizontally disposed fasteners, the mailbox assembly comprising:

a door disposed at one end;

a flag pivotally disposed on the mailbox assembly.

9. The device according to claim 8 further comprising an illuminated address disposed within the mailbox assembly and visible exteriorly on the mailbox assembly, the illuminated address in communication with the processor.

10. The device according to claim 9 further comprising a plurality of indicators disposed within and exteriorly visible from the dished tray, the indicators in communication with the processor.

11. The device according to claim 8 further comprising a plurality of indicators disposed within and exteriorly visible from the dished tray, the indicators in communication with the processor.

* * * * *